US005704620A

United States Patent [19]

Oliemans et al.

[11] Patent Number: 5,704,620

[45] Date of Patent: Jan. 6, 1998

[54] FLEXIBLE SKATE FRAME

[75] Inventors: Eduard Willem H. Oliemans, Aspen; Robert Smith Stoughton, Snowmass, both of Colo.

[73] Assignee: 99 Innovations, Inc., Aspen, Colo.

[21] Appl. No.: 497,284

[22] Filed: Jun. 30, 1995

[51] Int. Cl.[6] ..... A63C 17/06

[52] U.S. Cl. ..... 280/11.22; 280/11.27; 280/11.28

[58] Field of Search ..... 280/11.27, 11.28, 280/11.22, 11.19, 11.23, 87.042

[56] References Cited

U.S. PATENT DOCUMENTS

| | | | |
|---|---|---|---|
| 1,988,055 | 6/1935 | Stein . | |
| 2,689,743 | 9/1954 | Ware . | |
| 3,653,678 | 4/1972 | Collett . | |
| 3,774,924 | 11/1973 | Machatsch . | |
| 4,108,450 | 8/1978 | Coté . | |
| 4,272,090 | 6/1981 | Wheat . | |
| 4,272,091 | 6/1981 | Reid, Jr. | 280/11.28 |
| 4,398,735 | 8/1983 | Evans et al. | 280/11.28 |
| 4,402,521 | 9/1983 | Mongeon . | |
| 4,708,352 | 11/1987 | Vullierme | 280/11.28 X |
| 5,092,614 | 3/1992 | Malewicz | 280/11.22 |
| 5,257,793 | 11/1993 | Fortin . | |
| 5,330,208 | 7/1994 | Charron et al. . | |
| 5,342,071 | 8/1994 | Soo . | |
| 5,405,156 | 4/1995 | Gonella . | |

FOREIGN PATENT DOCUMENTS

| | | | |
|---|---|---|---|
| 0793551 | 3/1930 | Germany | 280/11.28 |

*Primary Examiner*—Christopher P. Ellis
*Attorney, Agent, or Firm*—Sheridan Ross P.C.

[57] ABSTRACT

Several embodiments of open and closed loop frames substantially elliptical in shape are disclosed for in-line skates. Some embodiments include independent suspension for each wheel. The frame is flexible to provide shock absorption and rebound. The frame stiffness increases with the applied load. The rocker of the skate is made to vary with the applied load, so that the skate has high maneuverability yet is very stable when gliding. The frame includes a boot mounting system which adds no stress concentrations, thus assuring even flex properties over the entire frame, and high durability. Overload protection is included to further enhance durability.

26 Claims, 12 Drawing Sheets

FLEXIBLE SKATE FRAME

CROSS REFERENCE PATENTS

U.S. patent application Ser. No. 08/126,695 filed Sep. 17, 1993 is hereby incorporated by reference.

FIELD OF INVENTION

The present invention relates to an in-line skate having an elliptical spring frame construction functioning to provide shock absorption, rebound and increased maneuverability for the in-line skate.

BACKGROUND OF THE INVENTION

Although some in-line skating takes place on very smooth surfaces, most of the time skating takes place on boardwalks, bike paths, streets and city parks. Rough surfaces are the rule rather than exception for in-line skaters.

In-line skates are also used for stunts. It is not uncommon to see skaters jump off ramps or walls, descend with high speeds down stairs or glide down handrails. In many cases the landings can be rough.

Skates on the market today are essentially rigid, and thus fully transmit the shocks encountered at the wheels to the skater's body. This makes skating on less-than-ideal surfaces uncomfortable and fatiguing, and thus, less enjoyable and safe. Many skates have frames which are bolted or riveted to the boots. The associated holes add stress concentrations to the frame which weaken it. To compensate, the frames are made heavier and more rigid.

Several attempts have been made to reduce the vibrations caused by rough roads by adding springs to the design. This increases the number of parts and makes construction of the skate more difficult. Below follows a description of the known prior art.

U.S. Pat. No. 1,988,055 (1935) to Stein discloses an exhibition style roller skate having a rigid roller frame and an extra wheel.

U.S. Pat. No. 4,108,450 (1978) to Coté discloses a forerunner of the in-line skate. An elongated bar may have a spring loaded rear end for use on a rough surface.

U.S. Pat. No. 4,272,090 (1981) to Wheat discloses a leaf spring support for a skate bogie (wheel support).

U.S. Pat. No. 5,257,793 (1993) to Fortin discloses an ice skate having a rigid blade support that is adjustable.

U.S. Pat. No. 5,342,071 (1994) to Soo discloses an in-line skate having a pair of rigid bridges supporting the wheels. Brake assemblies are mounted on the bottom of the skate shoe.

U.S. Pat. No. 5,405,156 (1995) to Gonella discloses a rubber shock absorber in a pivoting wheel frame for an in-line skate.

U.S. Pat. No. 3,774,924 (1973) to Machatsch discloses a shock absorbing suspension for a roller skate. U-shaped spring brackets and rubber gaskets cushion a movable wheel bracket.

U.S. Pat. No. 4,402,521 (1983) to Mongeon discloses a roller skate floating axle. Spring shocks support a leaf spring type axle assembly.

U.S. Pat. No. 2,689,743 (1954) to Ware discloses a twistable type shock absorber for roller skates. They assist in turning maneuvers which are a form of braking.

U.S. Pat. No. 3,653,678 (1972) to Collett discloses a leaf spring frame for a roller skate. Both fore and aft rocking motion as well as rough terrain shock absorption is provided.

Collett does not teach a single loop elliptical frame construction. Instead he teaches a pair of opposing leaf springs which form a gap between them. The rollerskate wheel assemblies are mounted at the extreme ends of the leaf spring pair. This construction does not lend itself to in-line skates.

U.S. Pat. No. 5,330,208 (1994) to Charron et al. teaches a unique in-line skate frame. In FIGS. 8–11 an upper portion of the frame has an elliptically shaped central opening 126. A forward and rearward facing yoke 122, 124 depend from the upper portions of the in-line skate frame. A pair of in-line skate wheels are supported by each yoke. This frame is inherently much stiffer at its inside wheels than its outside (forward and rearward) wheels. Thus, the frame must be "reverse rockered", with the outside wheels lower than the inside wheels in the undeflected position. This does not allow for high maneuverability.

The present invention offers a truly simple and elegant elliptical frame design to the in-line skate industry that features the performance advantages of shock absorption, rebound and high maneuverability. Both open loop and closed loop embodiments are disclosed. All the skate wheels are supported in a highly shock absorbent manner. Additionally, each in-line skate wheel can be independently suspended. The overall design is also light weight and can be produced in a cost efficient manner.

SUMMARY OF THE INVENTION

The main object of the present invention is to provide a shock absorbent elliptical frame for a more comfortable skating experience.

Another object of the present invention is to provide independent suspension for each in-line skate wheel.

Another object of the present invention is to provide a low cost and light weight frame for an in-line skate.

Another object of the present invention is to provide an in-line skate frame that rebounds stored energy, for a more efficient, less fatiguing, and safer skating experience.

Another object of the present invention is to provide a highly maneuverable frame which increases the performance for street hockey, stunts and figure skating. High maneuverability also increases safety for experienced skaters as it becomes easier to avoid obstacles.

Another object of the present invention is to provide a flexing frame with overload protection for a highly durable construction.

Another object of the present invention is to provide a frame which is easy to construct: one piece bars that can be easily and economically produced by stamping or injection molding.

Another object of the present invention is to provide a frame system that can interchange frames of different stiffnesses and rebound properties to accommodate skaters of different weights, capabilities, and styles of skating such as racing or making ski-like turns.

Another object of the present invention is to provide an in-line skate system where frame and mounting blocks form an integrated system.

Another object of the present invention is to provide a system in which the flexibility/stiffness is adjustable.

Another object of the present invention is to provide a system in which all wheels maintain contact with the road surface while gliding, even on less than ideal surface resulting in more control.

Another object of the present invention is to provide a mounting system which does not add any stress concentrations (i.e., drilling, riveting, etc.) to the frame, so that the frame maintains its structural strength as well as flex properties over the entire length.

Another object of the present invention is to provide mounting blocks which include 'sidewalls' which grip around the overload protection columns to allow vertical flexibility while maintaining high torsional and lateral stiffness.

Another object of the present invention is to provide a frame which functions as a cushion for landings and a springboard for jumps.

Another object of the present invention is to provide a frame for which the rocker is not a constant value, but varies with the load, so that a short radius rocker is present in the unloaded skate, with the rocker flattening out with increasing load. This allows greater maneuverability without sacrificing stability. The frame can be designed so that the rocker becomes completely flat at the average push-off force of the skater. In this way, all the wheels of the skate actively participate in the push-off, yet the skate has a rocker while initiating a turn for good maneuverability.

Another object of the present invention is to provide a mounting system which allows variable boot mount locations: from one single point at or near the center of the boot to multiple points distributed from front to back of the boot.

Another object of the present invention is to provide a boot mount system using one fixed mount (front or rear) and a second mount that is free to slide in the front to back direction. This changes the flex properties of the frame and allows the boot to remain relatively undeflected while the frame flexes.

Another object of the present invention is to provide a boot mount system using a fixed center mount with the front and back constrained laterally and torsionally, but free to slide in the front and back direction. This system can provide lateral and torsional support for the boot while allowing the maximum vertical flex of the frame.

Another object of the present invention is to provide a frame in which the cross-sectional shape of each bar varies along its length in such a way that the stress is evenly distributed along the length of the bar based on a given design load. This can maximize the amount of flex achievable while keeping the maximum stress below a given level. For a rectangular cross section bar, this includes varying the height and depth of the bar both independently and in concert.

Other objects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
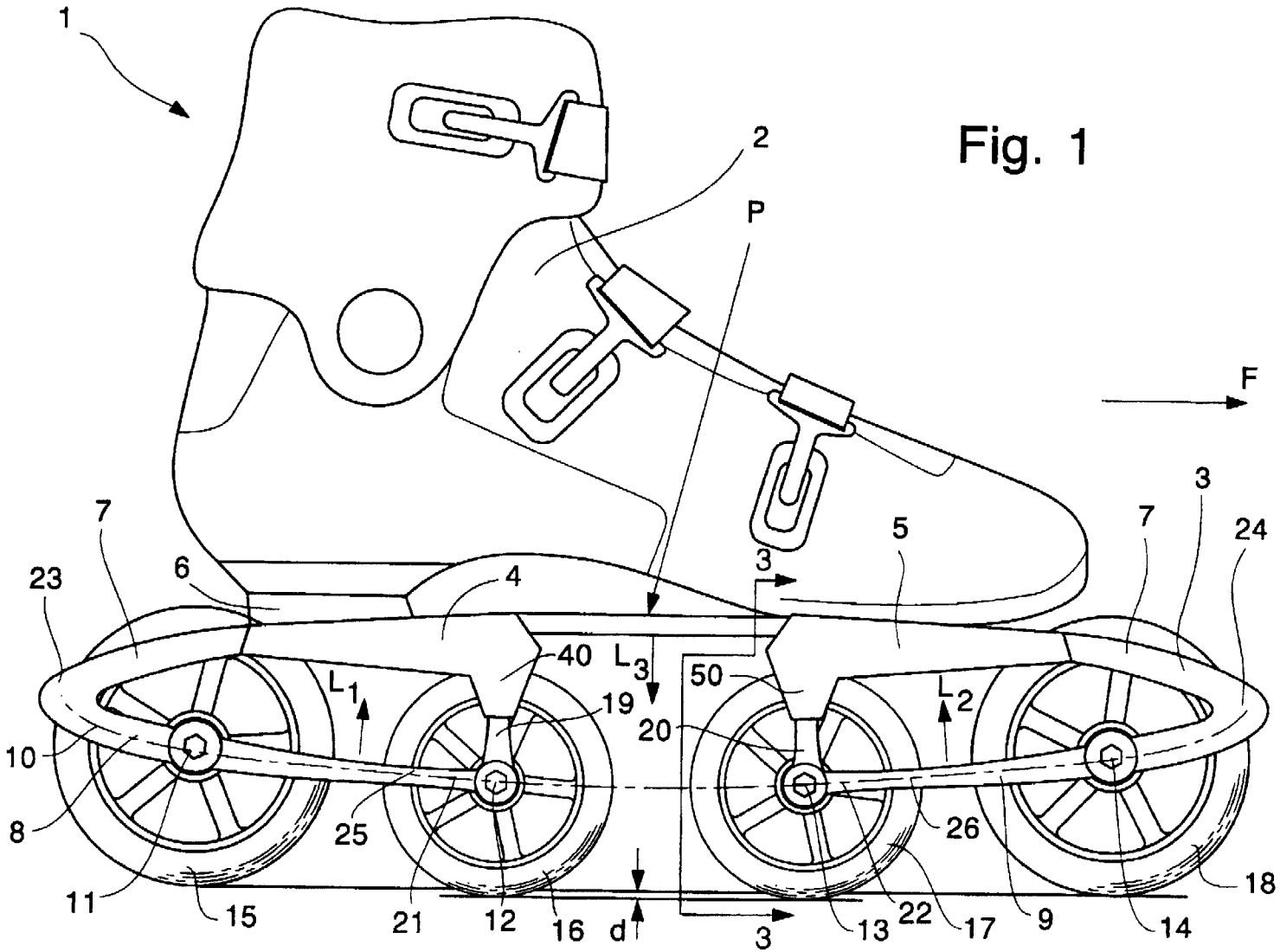
FIG. 1 is a right side plan view of the preferred embodiment.

Referring first to FIG. 1 an in-line skate 1 has a boot 2 having a bottom plane (not shown) coming out of the page at the bottom of the boot, an open elliptical frame 3, mounting blocks 4 and 5, and a heel elevator 6. The open elliptical frame 3 is symmetrical having a peak at P in the center of the ellipse and between the mounting blocks 4 and 5. The one-piece elliptical frame 3 includes an upper continuous leaf spring portion 7, a forward lower leaf spring portion 9, and a rear lower leaf spring portion 8. The line 10 passes along the center of the lower leaf spring portions 8, 9. The axles 11, 12, 13, 14 are supported along line 10 in leaf spring portions 8 and 9. The wheels 15, 16, 17, 18 are supported by axles 11, 12, 13, 14 respectively.

Overload protection posts 19, 20 extend upward from the lower leaf spring portions 8, 9. The overload protection posts 19, 20 hit either the upper continuous leaf spring portion 7 or the mounting blocks 4, 5, or both, under maximum load conditions. Under load, the open elliptical frame 3 flexes as indicated by arrows L1, L2, L3. The inner wheels 16, 17 are supported in the most flexible portion of the open elliptical frame 3 at the inside ends 21, 22 of the lower leaf spring portions 8, 9. This arrangement can provide a soft, comfortable ride for the skater. Additionally, the inside ends 21, 22 flex perpendicularly to the forward direction F of the skater. This flex can improve maneuverability by allowing an increased rocker distance d to be included when the skate is unloaded. The open elliptical frame 3 is thickest at ends 23, 24 to provide the necessary overall structural strength to support the load of the skater. The open elliptical frame 3 thins out at points 25, 26 to provide a more even distribution of stress. Thus, the open elliptical frame 3 is stiffer at the outside wheels 15, 18 than the inside wheels 16, 17. As the load increases, more of the load is transferred to the outer wheels, and the frame becomes stiffer. Also, since the inner wheels deflect more than the outer wheels, the rocker radius increases (i.e., the skate "flattens out") as the load increases. These are important characteristics for advanced skaters. The amount of rocker can be represented by distance d. The skate geometry and stiffness can be designed so that the skate flattens out (d=0) at a typical skater's push-off load. In this way, all the wheels actively participate in the push-off, yet the skate has a rocker when initiating a turn for improved maneuverability.

The mounting blocks 4, 5 have extensions 40, 50 which provide lateral and torsional support for the lower leaf spring portions 8, 9 via the overload protection posts 19, 20. Moving the mounting blocks 4, 5 toward or away from each other along the frame 3 provides an adjustable stiffness to the in-line skate 1. The closer the mounting blocks 4, 5 are to each other, the softer the frame.

It can been seen that the open elliptical frame 3 can be constructed from one piece bars that can be economically produced by stamping, fineblanking, or molding. It can also be seen that a variety of different stiffness frames can be readily adapted to the same boot. It can be seen that each wheel 15, 16, 17, 18 can be lifted individually by a bump in the road while leaving the remaining wheels in contact with the road (i.e., the wheels have independent suspension). It can be seen that the mounting blocks 4,5 remove any necessity to drill holes into the open loop elliptical frame 3. It can be seen that the cross-sectional shape of each bar can be varied along its length in such a way that the stress is evenly distributed along the length of the bar based on a given design load. This can maximize the amount of flex achievable while keeping the maximum stress below a given level. For a rectangular cross section bar, this bar, this includes varying the height and depth of the bar both independently and in concert.

The primary function of the overload protection posts 19, 20 is to limit the frame's flex to a certain amount of travel, thus making it nearly impossible to break the frame under normal use. The longer the columns are, the shorter the maximum travel is. A secondary function is to work in conjunction with the "walls" of the mounting blocks in order to increase the lateral and torsional stiffness of the frame. Yet another potential function is to accommodate springs or other shock absorbing devices as shown in FIGS. 17–22.

The primary function of mounting blocks 4 and 5 is to affix the frame to the boot in such a way that holes or other stress concentrators in the frame are not necessary. A secondary function is to provide walls (for columns) which play an important role in increasing the lateral/torsional stiffness. Thirdly, the flex properties of the frame can be varied by varying the length and/or position of the mounting blocks. The mounting blocks can also accommodate a "bed" of rubber-like material to add more stiffness, rebound, and/or damping and thus reduce vibration even more. This can make the frame flex properties readily adjustable by the user.

Slightly increasing the depth of the slots which accommodate the frame will make the clamping force of the mounting block entirely between the block and boot—no clamping pressure on the frame itself. In this way, the rear (preferable) or front mount can be made free to slide in the front to back direction. This will allow the frame to flex without flexing the boot, or reducing the flex of the boot. Adding a thin plate of low friction material such as teflon between the boot and the mounting block/top of frame will reduce the sliding friction at the top surface of the frame when the frame slides relative to the boot. Additionally, the mounting block can be made of, or coated with a low friction material (teflon-impregnated hard coat anodizing, if made of aluminum) to further reduce the sliding friction between the frame and the mounting block.

The stiffness/flex properties of the frame are adjustable in the following ways:

1. Mounting block positioning—changing the boot mount location affects the stiffness of the frame. Moving the mounts in towards the center reduces the frame stiffness while moving the mounts outward towards the front and back increases the frame stiffness.

2. The length of the mounting block(s) can be increased or decreased to allow the frame to flex less or more. In the extreme, a single one-piece mounting block can be used. The stiffness of the mounting block itself can also be varied.

3. Springs can be used between the top of the frame and the overload protection posts. Springs of different stiffnesses can be readily interchanged to vary the frame stiffness. These springs could also simply be a piece of resilient material such as rubber, or shock absorbers such as oil or compressed air type shocks. These shocks are common on automobiles, and now on mountain bikes as well.

4. Stiffeners such as posts or strips of material can be fixed to the frame, preventing or reducing flex in certain parts of the frame, and thus stiffening the frame.

The frame has a different stiffness with respect to a load on the inside wheels versus the outside (front and rear) wheels. The frame is stiffer with respect to a load on the outside wheels than with respect to a load on the inside wheels. Varying the cross sectional shape of the bars affects these two stiffnesses. There are two important ramifications of these two different stiffnesses:

the inner wheels deflect more than the outer wheels, so the rocker of the skate decreases (frame flattens out) with increasing load as the load increases and the frame flattens out, more load is put on the outside wheels, and thus, the frame becomes stiffer as the load increases.

While the elliptical frame 3 is shown as a bar with a rectangular cross section, any cross sectional shape may be used, such as circular, oval, tubular, hollow, rectangular and non-symmetrical shapes. Non-symmetrical shapes in which the left and right bars are mirror images may be useful. For example, a trapezoidal shape in which the bar height is greater on the inside than on the outside. A laminated construction, such as with skis, may also be attractive.

Figure 13:
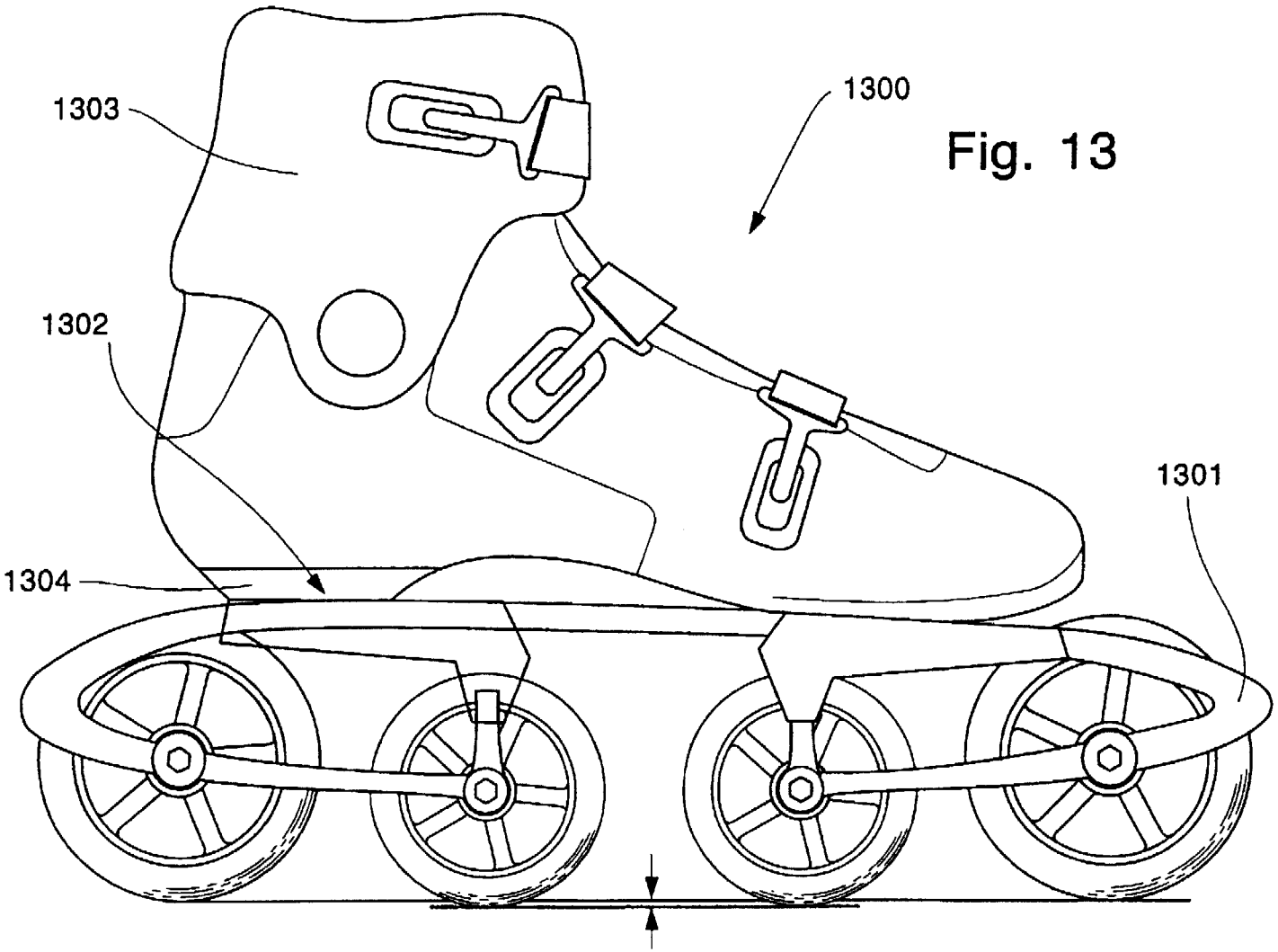
FIG. 13 is a right side plan view of yet another alternate embodiment having a non-symmetrical open ellipse design.

While the frame construction shown is basically elliptical in shape, this shape may be generalized. For example, the top half of the frame could follow the contour of the boot. FIG. 13 provides one example.

The shape of the inside and outside bars of a single skate can be different as well. It may be useful to make the inside bar slightly stiffer than the outside bar, as the skater's push-off tends to be stronger here.

Figure 2:
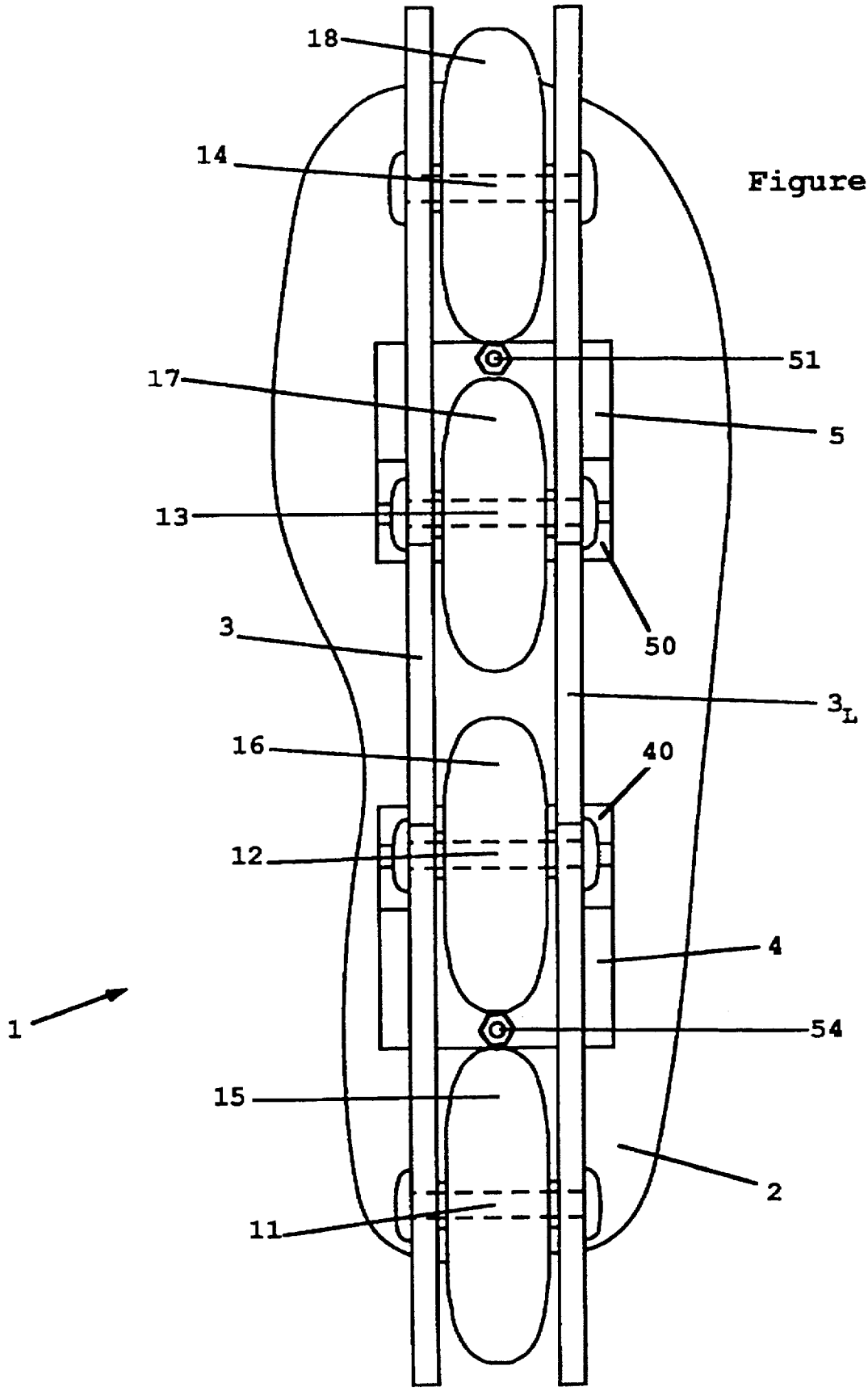
FIG. 2 is a bottom plan view of the preferred embodiment of FIG. 1.
Figure 4:
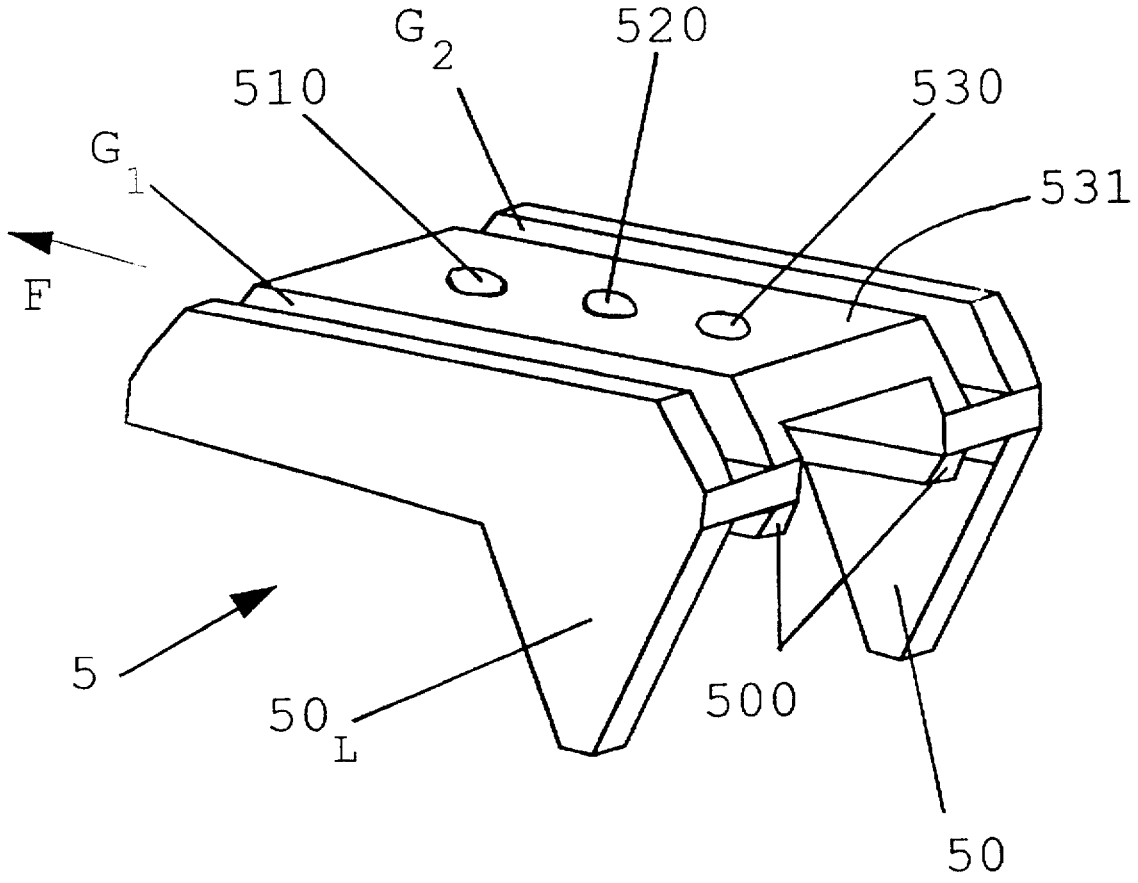
FIG. 4 is a perspective view of the mounting block of FIG. 1.

Referring next to FIG. 2 it can be seen that the open elliptical frame 3 is further comprised of a left frame member $3_L$ and a right frame member 3. Members $3_L$ and 3 may be identical, or may be mirror images, or may be asymmetrical. For example, inside member 3 may be stiffer than outside member $3_L$. Mounting blocks 4, 5 hold the members $3_L$ and 3 together in grooves $G_1$, $G_2$ as shown in FIG. 4. The axles 11, 12, 13, 14 provide the final support for the assembly $3_L$, 3, 4, 5. Bolt(s) 51 mounts the mounting block 5 to the boot 2. Bolt(s) 54 mounts the mounting block 4 to the boot 2. A unique aspect of this construction is that the frame itself is not self-supporting—the axles and/or boot must be secured to support the frame. It would be obvious to one skilled in the art to manufacture members $3_L$, 3 in a one piece construction having crosswise support members between them.

Figure 3:
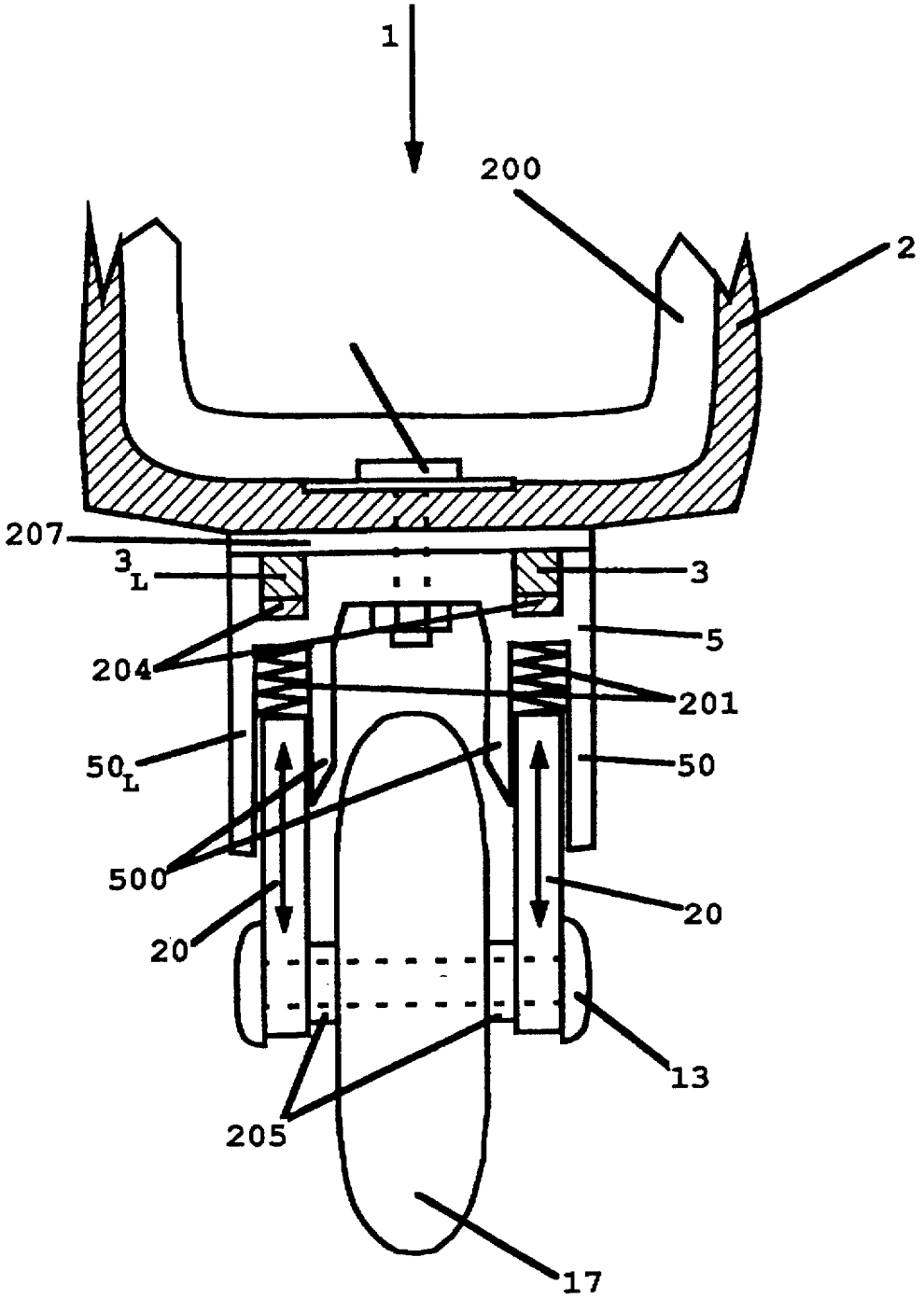
FIG. 3 is a sectional view taken along line A—A of FIG. 1.

Referring next to FIG. 3 the boot 2 has a liner 200. Extension 50 is mirrored in extension $50_L$. Optional inside extensions 500 offer extra lateral stability for the in-line skate 1 if desired. Optional springs 201 offer extra shock absorption and adjustable stiffness if desired. Optional dampening material 204 offers extra damping if desired. The thickness of axle spacers 205 can be increased to further separate frame members $3_L$, 3 for various mounting blocks and/or wheel combinations. Optional damping pad 207 offers extra damping if desired.

Referring next to FIG. 4, holes 510, 520, 530 provide access for bolt(s) 51 of FIG. 2. Planar top surface 531 distributes the skater's load evenly and eliminates wear producing stress concentrations. The depth of slots $G_1$, $G_2$ can be increased to permit a slight forward and backward movement of the frame members $3_L$, 3 if desired. The mounting block allows variable boot mount locations. A combination of one fixed mount and one sliding mount can be used.

Figure 5:
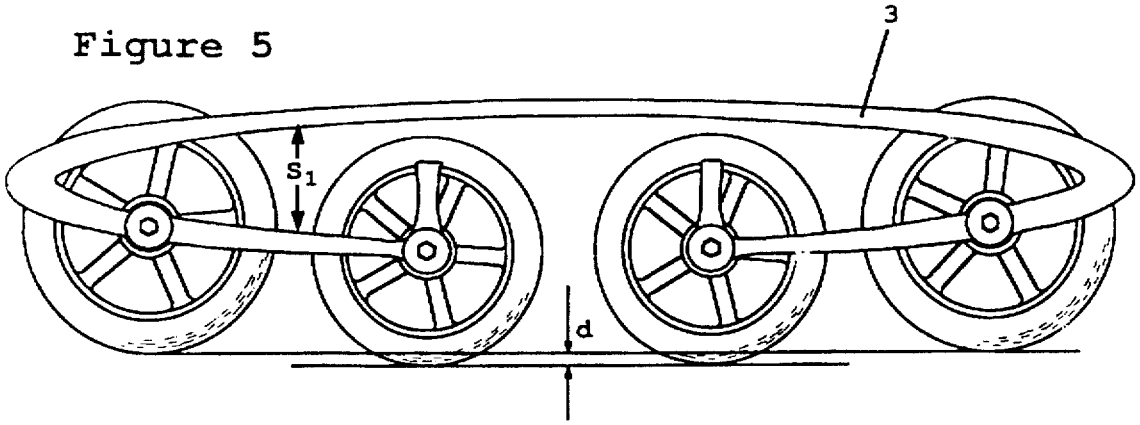
FIGS. 5, 6, 7 are right side plan views of the frame of the preferred embodiment of FIG. 1 with the mounting blocks removed shown in a sequence under unloaded, loaded, and overloaded conditions, respectively.
Figure 6:
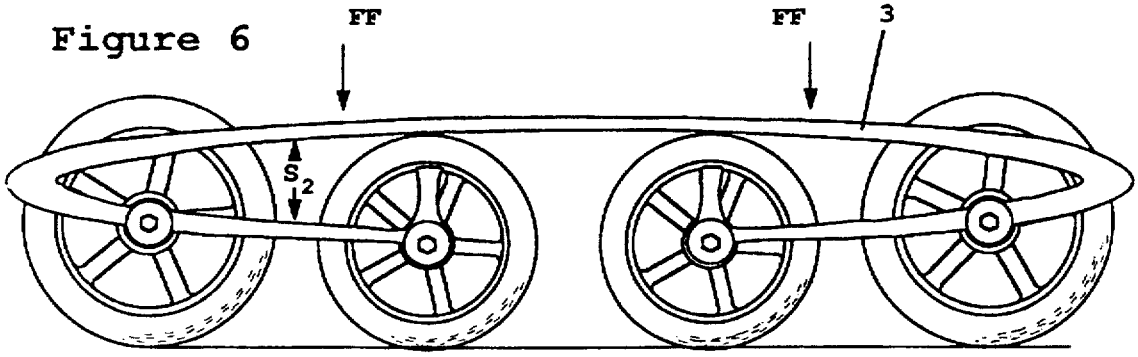
Figure 7:
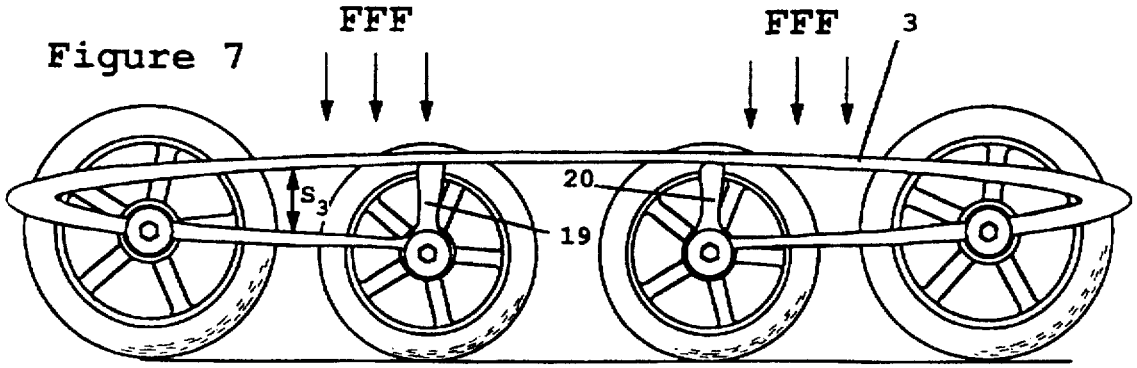

Referring next to FIGS. 5, 6, 7 the open elliptical frame 3 is seen in an undeflected state in FIG. 5. $S_1$ is maximal. Also, the rocker offset d is maximal. FIG. 6 shows $S_2$ at a smaller distance as the frame 3 flattens out and becomes stiffer by force FF. FIG. 7 shows a maximal force FFF forcing the overload posts 19, 20 against the frame 3. $S_3$ is minimal. The overload posts 19, 20 protect the frame 3 from breaking.

Figure 8:
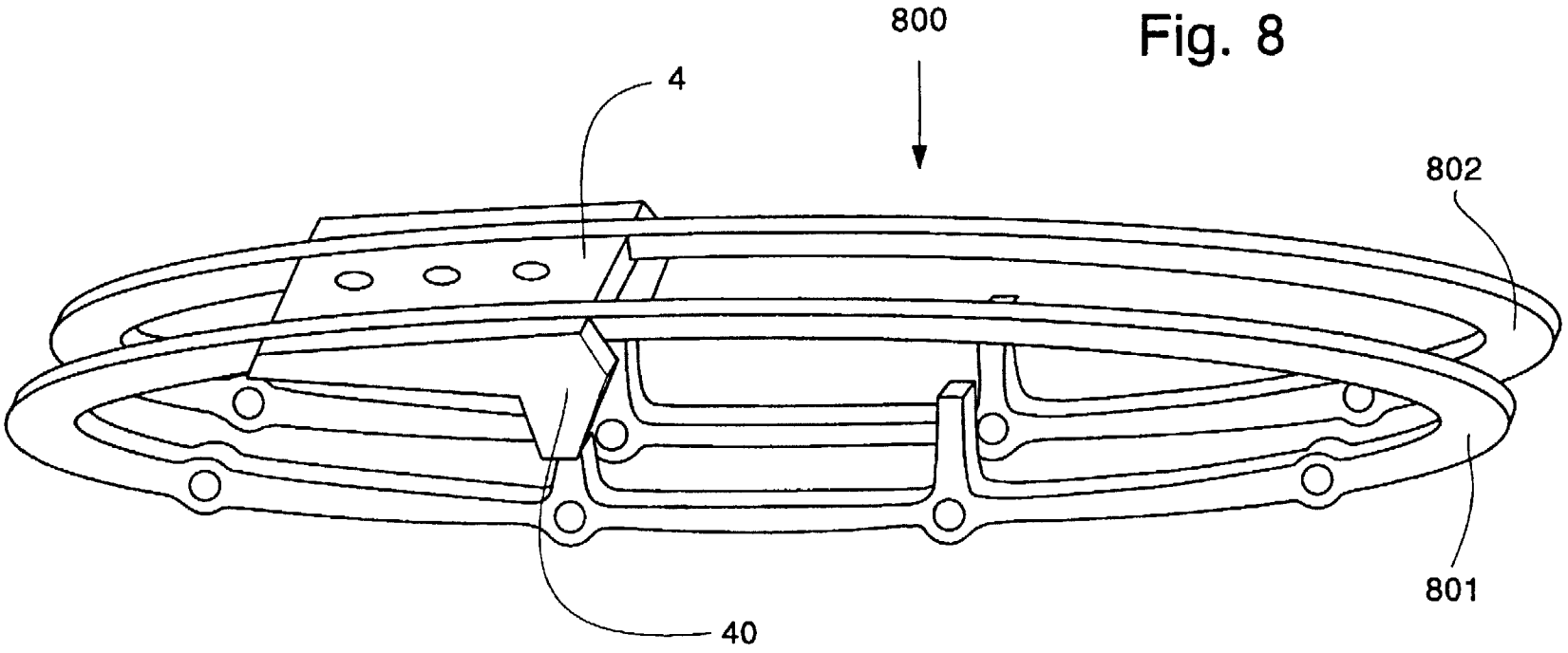
FIG. 8 is a perspective view of an alternate embodiment of a closed loop elliptical frame dismounted from the boot.
Figure 9:
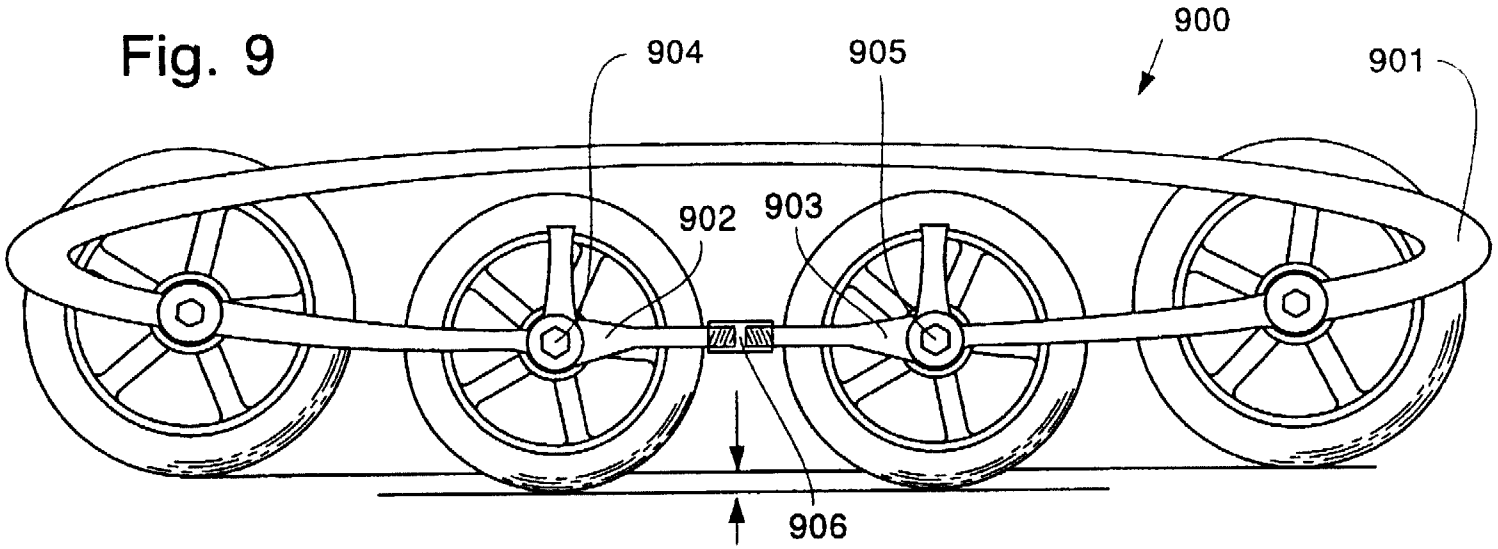
FIGS. 9, 10 are right side plan views of yet another alternate embodiment using connecting rods to form a closed loop design.

Referring next to FIG. 8 a closed loop elliptical frame 800 is shown. The same mounting block 4 is used. All functionality of the frame assembly 4, 801, 802 are identical to the embodiment of FIG. 1. This embodiment offers a stiffer ride than the preferred embodiment of FIG. 1, with improved lateral and torsional stiffness, realized by closing the elliptical frame. The wheels are no longer suspended independently.

Figure 10:
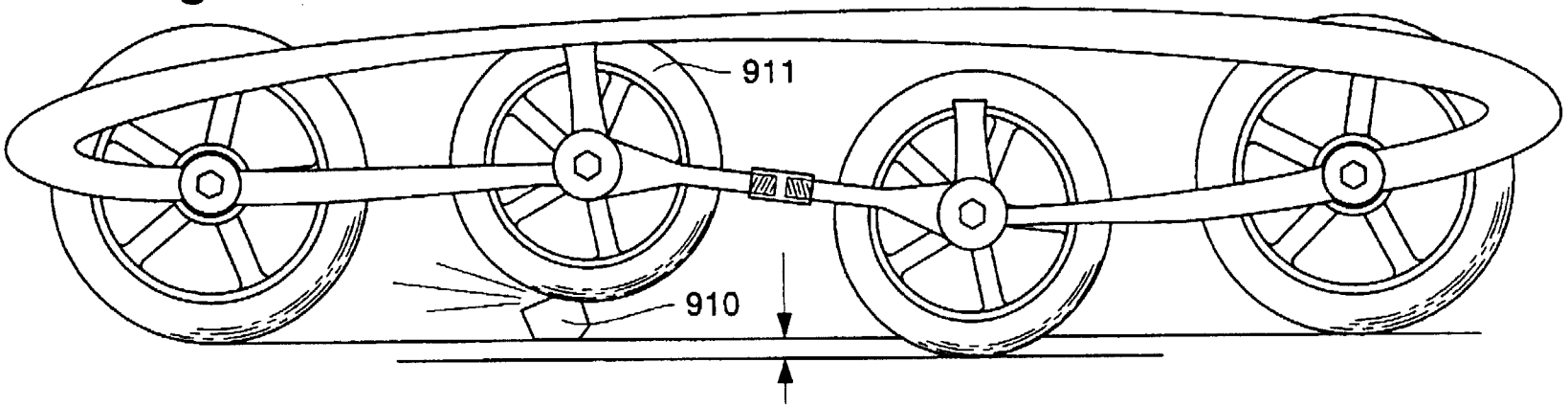
Figure 11:
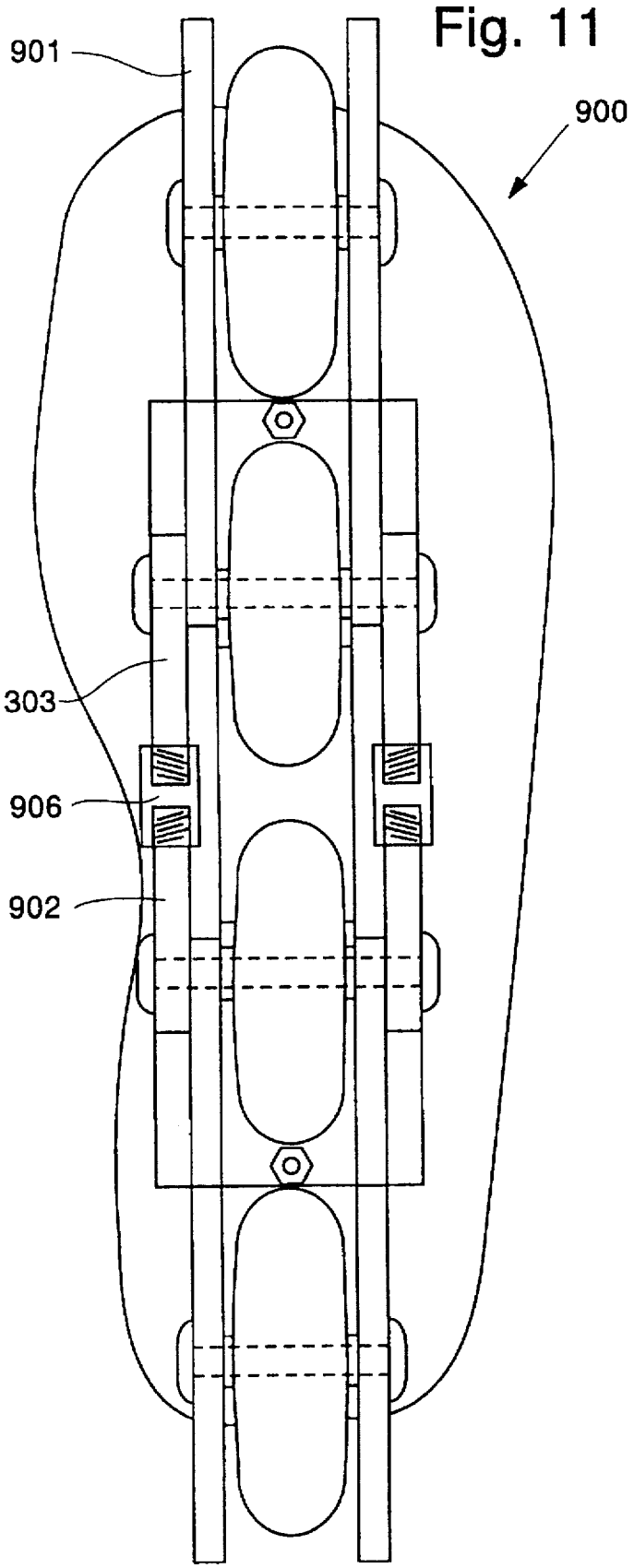
FIG. 11 is a bottom plan view of the embodiment of FIG. 9.
Figure 12:
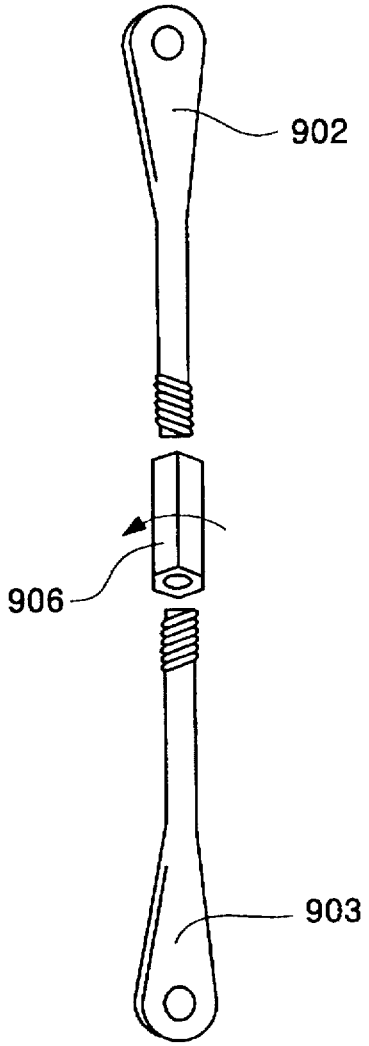
FIG. 12 is a close up view of the tension assembly of FIG. 9.

Referring next to FIGS. 9, 10, 11, 12, the FIG. 1 embodiment has been modified to create a closed loop hybrid frame 900. Frame member 901 is open. Connecting rods 902, 903 pivot at points 904, 905 which may be the axles. The adjusting nut 906 can bring the connecting rods together under tension to close the loop and to increase the frame stiffness. FIG. 10 shows how this frame design offers independent wheel suspension as wheel 911 passes over rock 910. It can be seen that connecting rods 902, 903 add lateral support to the frame 900 while maintaining independent wheel suspension.

Referring next to FIG. 13 a skate 1300 has a boot 1303 mounted on a frame 1301. The frame 1301 is based on the open ellipse of FIG. 1, but is non-symmetrical. The high point of the frame is at 1302 under the heel 1304 of the boot 1303. This design eliminates the need for a separate heel lift. This modification may also provide more rebound energy during skating.

Figure 14:
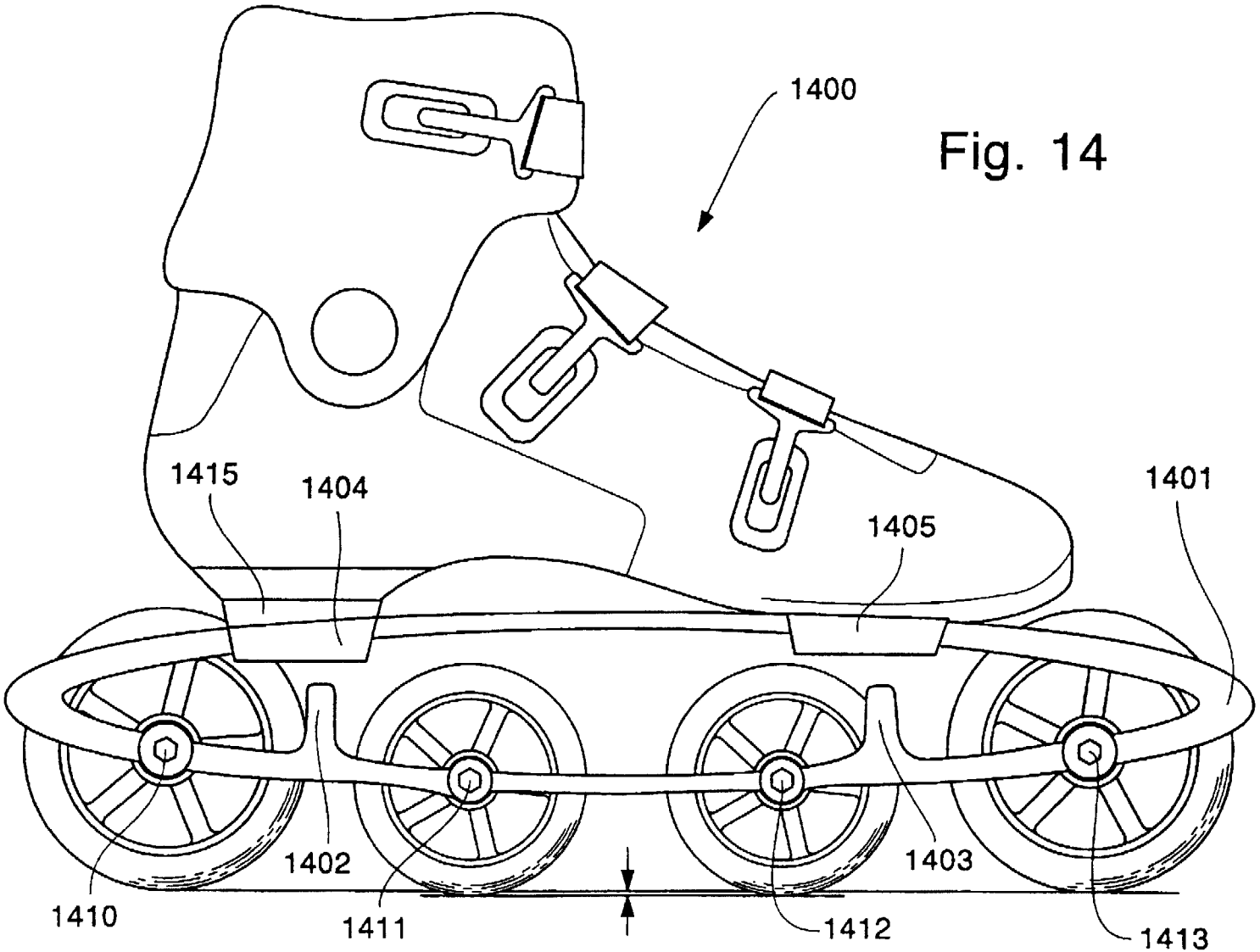
FIG. 14 is a right side plan view of yet another embodiment of a closed loop elliptical frame having overload protection posts directly below the mounting blocks.

Referring next to FIG. 14 a closed loop embodiment is shown as skate 1400. Frame member 1401 is supported by axles 1410, 1411, 1412, and 1413. Mounting blocks 1404, 1405 serve to stop overload protection posts 1402, 1403 which are located between the axles rather than over the axles. An optional heel elevator 1415 is shown.

Figure 15:
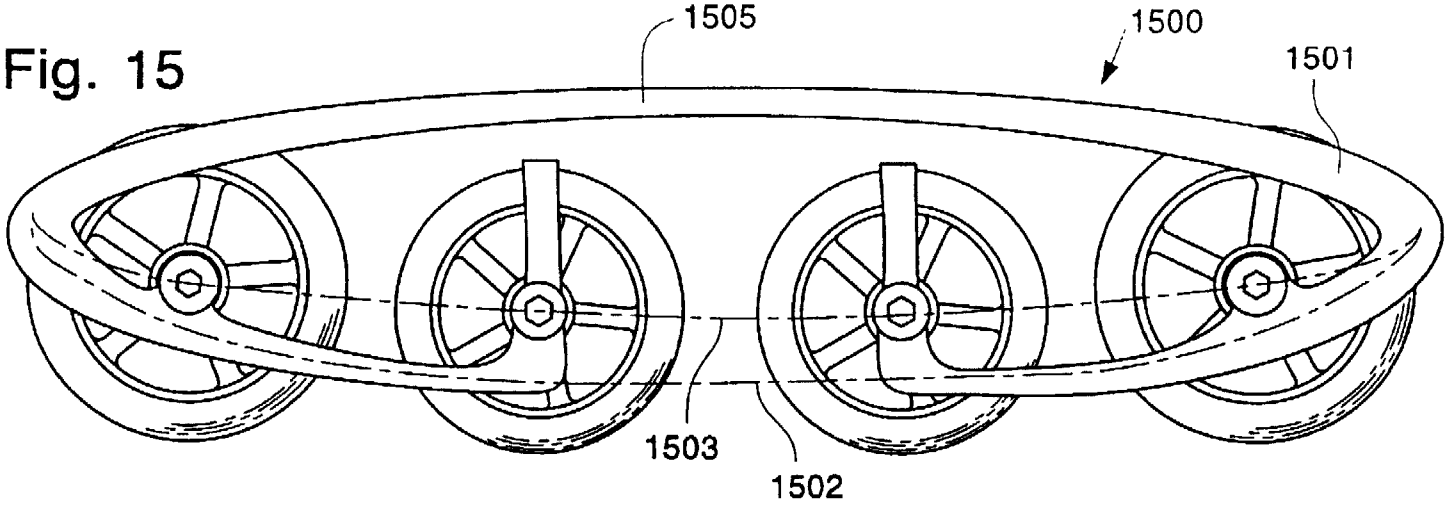
FIG. 15 is a right side plan view of yet another embodiment of an open loop elliptical frame hayin9 off-center axle mountings.

Referring next to FIG. 15 a skate 1500 has a frame member 1501 that features a lower height for the top of the elliptically shaped frame at 1505. The axles are mounted above the bottom half of the elliptical center line 1502 at a higher mounting line 1503. This embodiment is useful for large ellipses which otherwise would tend to raise the skater too high off the ground.

Figure 16:
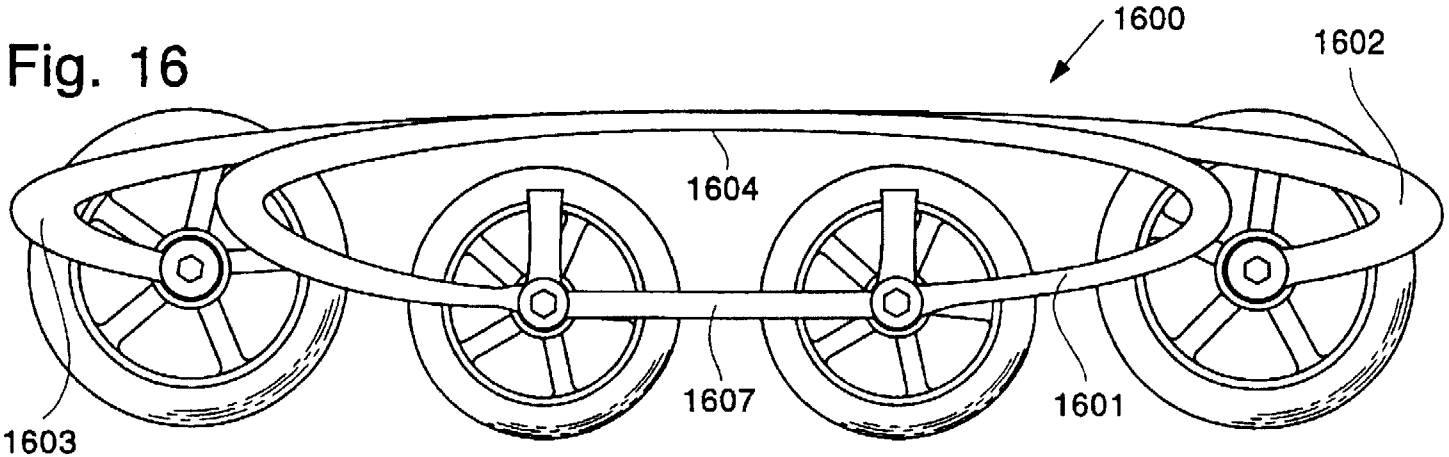
FIG. 16 is a right side plan view of yet another embodiment of a hybrid frame having two ellipses.
Figure 17:
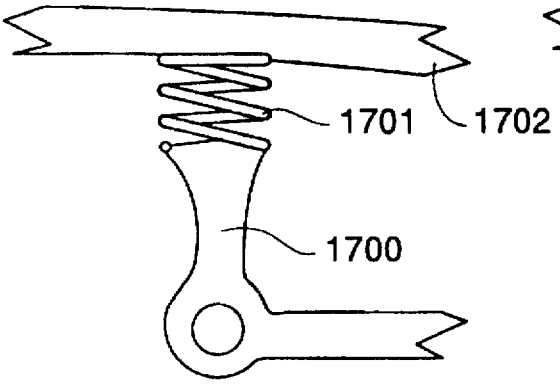
FIGS. 17 through 22 are right side plan views of alternate embodiments of overload protection post assemblies.
Figure 18:
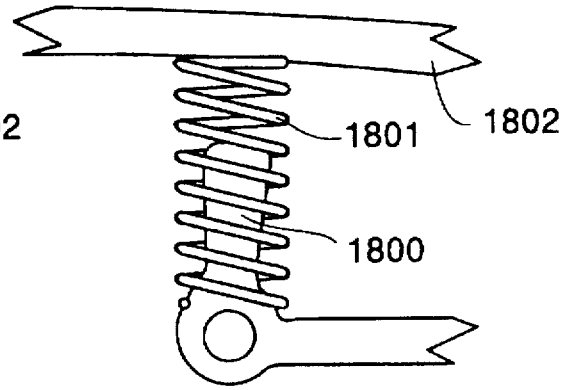
Figure 19:
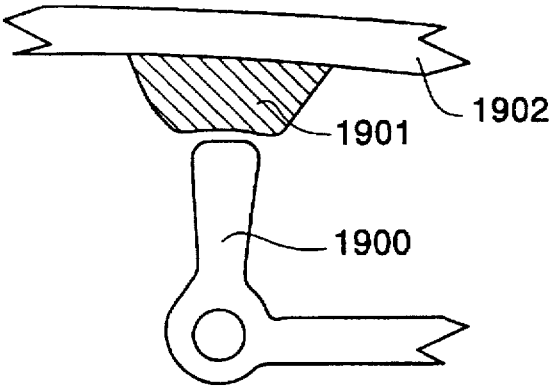
Figure 20:
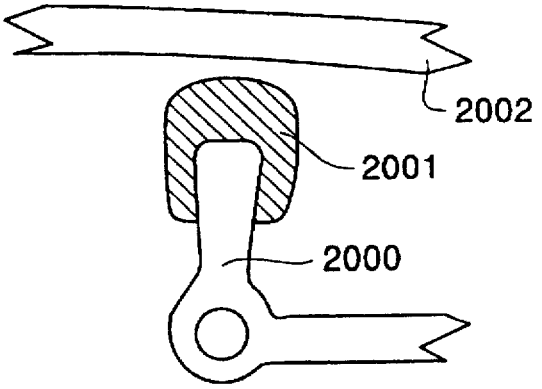
Figure 21:
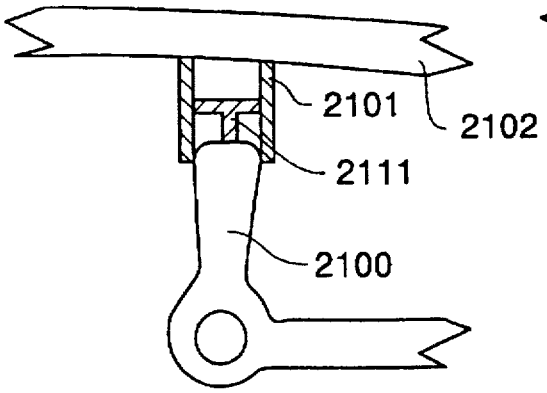
Figure 22:
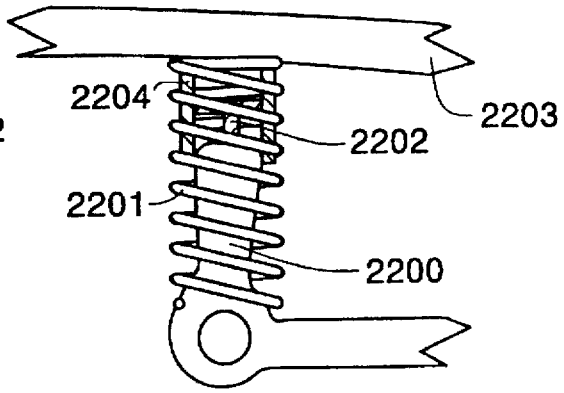

Referring next to FIG. 16 a double elliptical frame 1600 is shown. The inner frame 1601 shares a top leaf 1604 with the outer frame 1602, 1603. Although inner frame 1601 is a closed loop, it could have a connecting rod design at 1607 as shown in FIGS. 8–12, or an open loop design. While lower leaf springs 1602, 1603 are open loop, they could be closed loop. Thus, a wide variety of suspension characteristics can be designed from the above teachings.

FIGS. 17–22 show various designs of overload protection assemblies which can also be used to make the frame stiffness/flex properties easily adjustable. Overload protection (OP) rod 1700 forces spring 1701 against frame 1702. OP rod 1800 forces spring 1801 against frame 1802. OP rod 1900 forces resilient pad 1901 against frame 1902. OP rod 2000 forces resilient pad 2001 against frame 2002. OP rod 2100 forces shock absorber piston 2111 up the shock 2101 which is mounted on frame 2102. OP rod 2200 forces spring 2201 into the frame 2203 and piston 2202 into the shock 2204. These embodiments can dampen vibrations, change the force-deflection curve to make the frame stiffen with load, and increase the rebound.

The teachings of a two wheel skate in the co-pending 08/126,695 application can be applied to and combined with the present application.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A suspension apparatus for a skate comprising:

a first and a second flexible frame member, each substantially elliptical in shape;

means to connect the first and the second frame members together in a substantially parallel manner and substantially perpendicular to a bottom plane of a boot;

said frame members functioning to support a plurality of wheels;

wherein said frame members flex during skating thereby allowing a variable alignment of said wheels during skating.

2. The apparatus of claim 1, wherein the means to connect the first and the second frame members together further comprise a plurality of axles having the dual functions of connecting the first and second frame members together and supporting the plurality of wheels.

3. The apparatus of claim 2, wherein said means to connect the first and the second frame members together further comprises a mounting block having a pair of substantially parallel grooves, one for said first frame member and one for said second frame member, and a fastener means functioning to secure the suspension apparatus to the boot.

4. The apparatus of claim 3, wherein the fastener means further comprises a bolt between the boot and the mounting block.

5. The apparatus of claim 3, wherein the mounting block further comprises a planar top surface engaging a bottom surface of the boot, thereby distributing a load from a skater's weight.

6. The apparatus of claim 3, wherein the mounting block further comprises a downward extension which engages an overload protection post on the first frame member, thereby providing lateral support for the suspension apparatus.

7. The apparatus of claim 6, wherein the overload protection post further comprises an extension of a lower leaf of the first frame member that under a maximum load contacts an upper leaf of the first frame member.

8. The apparatus of claim 3, wherein the mounting block further comprises a variable position along the first and the second frame members, thereby providing an adjustable stiffness to the suspension apparatus.

9. The apparatus of claim 7, wherein the overload protection post further comprises a spring means to modify the flexible characteristics of the apparatus by pushing against the upper leaf of the first frame member.

10. The apparatus of claim 1, wherein said first and second frame members further comprise a forward and a rearward portion, and said frame members vary in stiffness between said forward and rearward portions to provide an increasing stiffness of the apparatus with an increasing load.

11. The apparatus of claim 1, wherein said first and second frame members further comprise a forward and a rearward portion, and said frame members vary in stiffness between said forward and rearward portions to provide a variable rocker alignment of said wheels that decreases with an increasing load.

12. The apparatus of claim 7, wherein said lower leaf further comprises a forward member and a rearward member separated by a space, thereby forming an open loop elliptical suspension frame member.

13. The apparatus of claim 12, further comprising a connecting rod between said forward and rearward members of the lower leaf spring.

14. The apparatus of claim 1, wherein said first and second frame members each further comprise a non-symmetrical elliptical shape having a high point near a heel of the boot.

15. The apparatus of claim 1 wherein said first and second frame members each have a different stiffness.

16. The apparatus of claim 1, wherein said first frame member further comprises a tapered central portion functioning to evenly distribute a load placed on the first frame member.

17. The apparatus of claim 4, further comprising a second mounting block secured to the bolt and slidingly engaged with the first and the second frame members.

18. The apparatus of claim 2, wherein said plurality of axles each further comprise a mounting means above a lower leaf portion of the first frame member.

19. A resilient frame member for use in a suspension system for a skate, comprising:

an upper and a lower leaf spring;

forward and rearward extension members interconnecting said upper and lower leaf springs to create a substantially elliptical frame member; and mounting means for a plurality of wheels on said lower leaf spring and said forward and rearward elliptical extension members.

20. An in-line skate frame comprising:

a first flexible frame member substantially elliptical in shape;

a second flexible frame member substantially elliptical in shape;

a mounting means functioning to secure the first and second frame members onto the bottom surface of the boot;

a plurality of axle support means functioning to support a plurality of wheels between said first and second elliptical frame members;

wherein said frame members flex during skating to vary the alignment of said wheels.

21. A suspension apparatus for a skate comprising:

first and second frame members, each substantially elliptical in shape and functioning to support a plurality of wheels therebetween;

a mounting block to connect said first and second frame members together in a substantially parallel manner and mounted under a boot substantially perpendicular to a bottom plane of the boot, said mounting block having a groove for each first and second frame member and a downward extension which engages an overload protection post on at least one of said frame members to provide lateral support for the suspension apparatus; and fastener means to secure the suspension apparatus to the boot.

22. The apparatus of claim 21, wherein the overload protection post further comprises an extension of a lower leaf of the first frame member that under a predetermined load contacts an upper leaf of the first frame member.

23. The apparatus of claim 22, wherein the overload protection post further comprises a spring means to modify the flexible characteristics of the apparatus by pushing against the upper leaf of the first frame member.

24. The apparatus of claim 23, wherein said lower leaf further comprises a forward member and a rearward member separated by a space, thereby forming an open loop elliptical suspension frame member.

25. A suspension apparatus for a skate comprising:

first and second frame members, each substantially elliptical in shape and functioning to support a plurality of wheels therebetween;

a mounting block to connect said first and second frame members together in a substantially parallel manner and mounted under a boot substantially perpendicular to a bottom plane of the boot, said mounting block having a groove for each first and second frame member and is variably positionable along the first and the second frame members to provide an adjustable stiffness to the suspension apparatus; and fastener means to secure the suspension apparatus to the boot.

26. The apparatus of claim 3, wherein said mounting block does not create a fatigue point on either of said frame members.

* * * * *